US008590237B2

(12) United States Patent
Stella

(10) Patent No.: US 8,590,237 B2
(45) Date of Patent: Nov. 26, 2013

(54) SYSTEMS OF MODULAR READY TO ASSEMBLE STRUCTURES AND RELEVANT FINISHED BUILDINGS

(76) Inventor: Paolo Stella, Milan (IT)

( * ) Notice: Subject to any disclaimer, the term of this patent is extended or adjusted under 35 U.S.C. 154(b) by 0 days.

(21) Appl. No.: 13/261,229

(22) PCT Filed: Sep. 24, 2010

(86) PCT No.: PCT/IT2010/000405

§ 371 (c)(1),
(2), (4) Date: Mar. 23, 2012

(87) PCT Pub. No.: WO2011/036689

PCT Pub. Date: Mar. 31, 2011

(65) Prior Publication Data

US 2012/0198783 A1 Aug. 9, 2012

(30) Foreign Application Priority Data

Sep. 25, 2009 (IT) ..... MI09A1644

(51) Int. Cl.
*E04C 1/00* (2006.01)

(52) U.S. Cl.
USPC ..... 52/309.1; 52/309.4; 52/309.15; 52/270

(58) Field of Classification Search
USPC ..... 52/90.1, 223.1, 223.8, 223.9, 223.11, 52/269, 270, 281, 282.3, 284, 309.1, 52/309.4, 309.15, 309.16
See application file for complete search history.

(56) References Cited

U.S. PATENT DOCUMENTS

| | | | | |
|---|---|---|---|---|
| 3,605,353 | A * | 9/1971 | Marcott | 52/91.3 |
| 3,984,957 | A * | 10/1976 | Piazza | 52/309.9 |
| 4,612,741 | A | 9/1986 | Jacobson | |
| 4,754,583 | A * | 7/1988 | Jenn | 52/88 |
| 6,006,480 | A * | 12/1999 | Rook | 52/309.12 |
| 6,415,558 | B1 * | 7/2002 | Cherry | 52/79.1 |
| 6,513,292 | B2 * | 2/2003 | Kumon | 52/309.9 |
| 6,931,803 | B1 | 8/2005 | Davis et al. | |
| 8,191,318 | B2 * | 6/2012 | Kitagawa | 52/82 |
| 2010/0293868 | A1 * | 11/2010 | Holzworth | 52/79.5 |
| 2010/0325989 | A1 * | 12/2010 | Leahy | 52/270 |

FOREIGN PATENT DOCUMENTS

| | | |
|---|---|---|
| CA | 2150038 | 11/1996 |
| CA | 2571958 | 6/2007 |
| FR | 1603060 | 3/1971 |
| JP | 2000050744 | 2/2000 |

* cited by examiner

*Primary Examiner* — James Buckle, Jr.
(74) *Attorney, Agent, or Firm* — Stetina Brunda Garred & Brucker

(57) ABSTRACT

A system suitable for making buildings, comprising: modular, easily to assemble components which are in the form of polylateral frames and which consist of at least three sub-components, each formed by standard elements having means for reciprocal coupling. Said standard elements having a core made of co-polymeric material and being coated by a common skin-like layer made basically of carbon, glass-fiber compositions.

11 Claims, 12 Drawing Sheets

SYSTEMS OF MODULAR READY TO ASSEMBLE STRUCTURES AND RELEVANT FINISHED BUILDINGS

BACKGROUND OF THE INVENTION

The present invention concerns systems to bring about building bodies as warehouse, storages, garages, hangars, shelters for artisan-, industry-, sport-, military, entertainment-spaces, field hospitals and second line structures and the like, comprising modular, easily in situ to assemble, finished structures.

In a first embodiment, the system according to the invention is substantially comprised of assemblable components like trilateral (i.e. open on one side) frames, wherein the three other sides consists of at least two sub-components which involve standard, easily assemblable elements incorporating suitable form-coupling structures that show diversity of materials selected from the group of the so-called "composites" mainly comprising fibers and synthetic of (co)-polymers, preferably expanded or in foamed form.

Typically the frame-forming elements of said components show an integral structure formed of two side-walls having enlarged upper portions as well as a central core between said terminal walls which are externally defined (together with said core) by continuous film-like layers of composite material (skins) within which is enclosed a polymeric reinforcing material.

According to an advantageous feature of the invention, said structure is able to house all the service elements such as those of the air conditioning, of the general electric apparatus (cables, switchers, etc.), of the lighting, heating etc.

Significantly, at a parity of materials, the volumetric size of the core is critically correlated to the sum of volumetric sizes, defined by said lateral walls. For very big building bodies f.i. with spans higher than 10 meters, a reinforcing ribbing is applied at least on one of the assembled component faces.

PRIOR ART

The need and request of building bodies of the "third type" i.e. of the type different from the classic sky-scrapers for offices, hotels, residences and the like, and from the big industrial factories, is exponentially increased in the last recent decades, in both cases, big buildings are involved which substantially consist of a big self-erecting, in situ formed structure consisting f.i. of metallic and/or reinforced concrete and by plugging panels of preferably reticulated glass.

The field of the above mentioned third type buildings comprises industrial or pseudo-industrial bodies pre-formed and in situ assembled. The components and elements thereof of said "third type" are particularly suitable for the above mentioned structures of f.i. hangar, shelter, field hospital and the like. However the conventional building systems for these constructions have shown gaps and inconveniences which do not consent to satisfy contemporaneously all the exigencies and characteristics requested by a continuously evolving market.

For instance, the Canadian Patent n° 2571958 describes a shelter to be rapidly assembled, formed by semi-circular or semi-elliptic elements of single film layers. Even if such type of construction has undoubted merits, it is nevertheless delicate, not sufficiently resistant to strong winds and inclement weathers, badly insulated, and per se complicated because of said single thin layers. In its complexity, the construction according to said Canadian Patent shows other drawbacks due to the fact that its components are not modular.

Japanese Patent Publication JP 200050744 describes a structure similar to that of the above Canadian Patent, which structure moreover needs compressed air to keep it erected.

The U.S. Pat. No. 6,599,610 describes a multi axial reinforcing laminate in which plural sheets each having plural carbon fiber yarns arranged in parallel, are laminated and stitched integrally by means of threads to ensure that the directions of said yarns are kept at different angles against a reference direction. This laminate can contain at least a layer of woven not-woven fiber. Said patent needs and suggests several sophisticated means to obtain laminates and film layer.

The International Patent Publication WO2008/088815 describes a high strength, light weight composite having: a)—a core comprising a thermo set polymer; b)—a laminate bonded to at least a portion of the core surface, comprising (i) at least one layer of fibrous material and (ii) at least one layer of thermo set binder which is bonded to at least a portion of the surface of said layer (i). Each layer of said binder can comprise a low density filler. Up to to-day the possible embodiments of the above building bodies with said materials and structures have shown several difficulties due to the complexity of the forming operations.

SUMMARY OF THE INVENTION

A first object of the present invention is to provide a system whit modular components which are easily assembled in situ, do not show the inconveniences of the Prior Art and consent to bring about buildings and construction bodies capable to satisfy the various requirements of a market undergoing big evolutions.

A second object is to provide systems of high versatility and flexibility to build up bodies of high capacity with span (without intermediate pillars) of at least 25 meters even in the presence of snow and wind charges.

Still another object is to provide modular, ready to be assembled and disassembled (f.i. about 200 $m^2$/day/3 persons) structures to embody large buildings.

Another object is to provide modular structures which incorporate (built-in) all service apparatus namely cable, machinery, box, lines, commands, joints, relays, etc. of air conditioning-, power-, lightning-, alarm-, security-, installations; moreover these structures must be easily compactable for f.i. transportation, storage, logistic purposes.

These and other objects are easily reached with the systems, structures, components and minor parts of the invention, whose main characteristics are recited in the claims (at the end of this description) which however are to be considered also here incorporated.

BRIEF DESCRIPTION OF THE DRAWINGS

Features and advantages of the invention will be better understood from the following description of the preferred embodiments shown in the accompanying drawings in which.

DETAILED DESCRIPTION OF THE PREFERRED EMBODIMENTS

Figure 10:
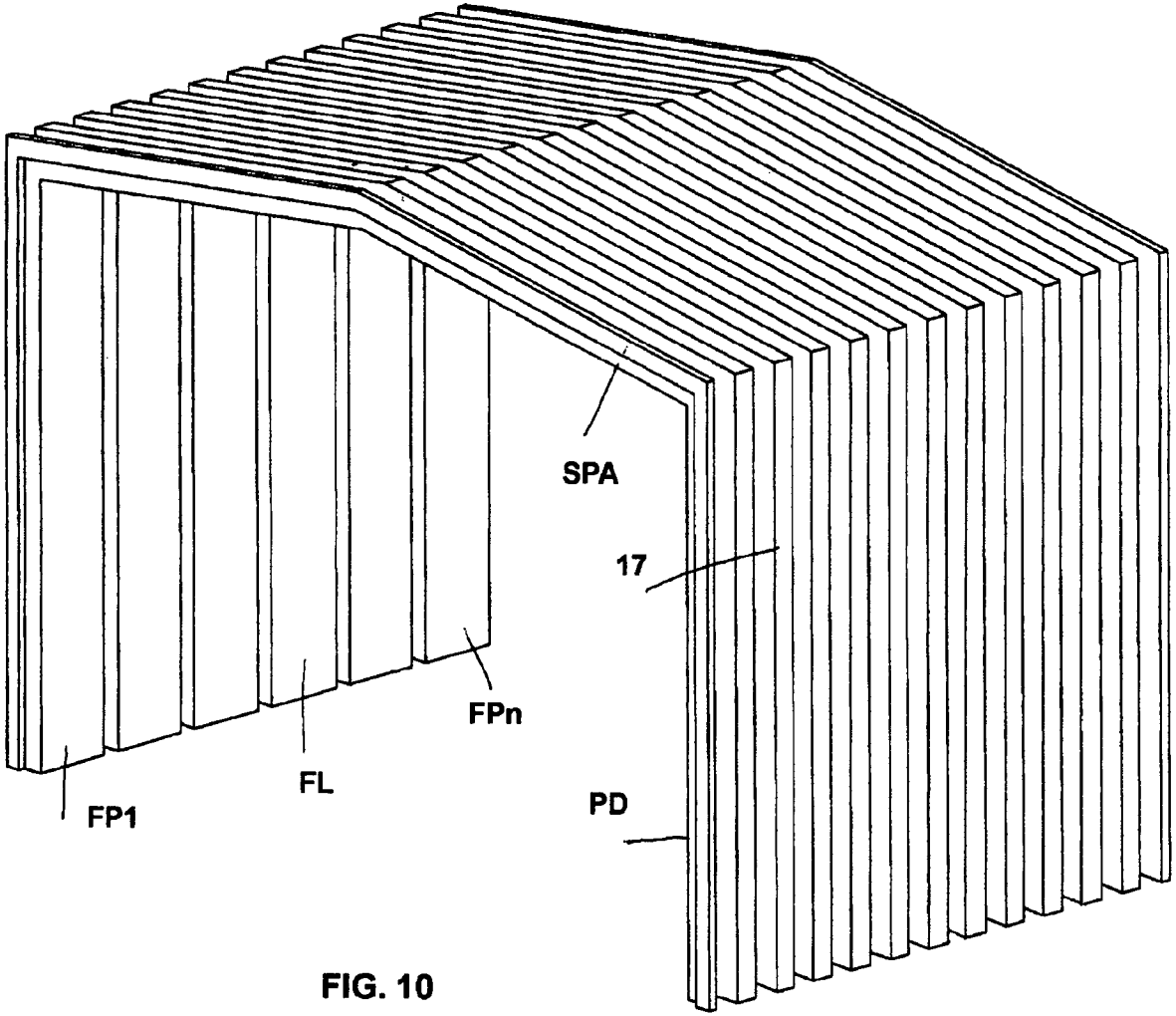
Figure 11:
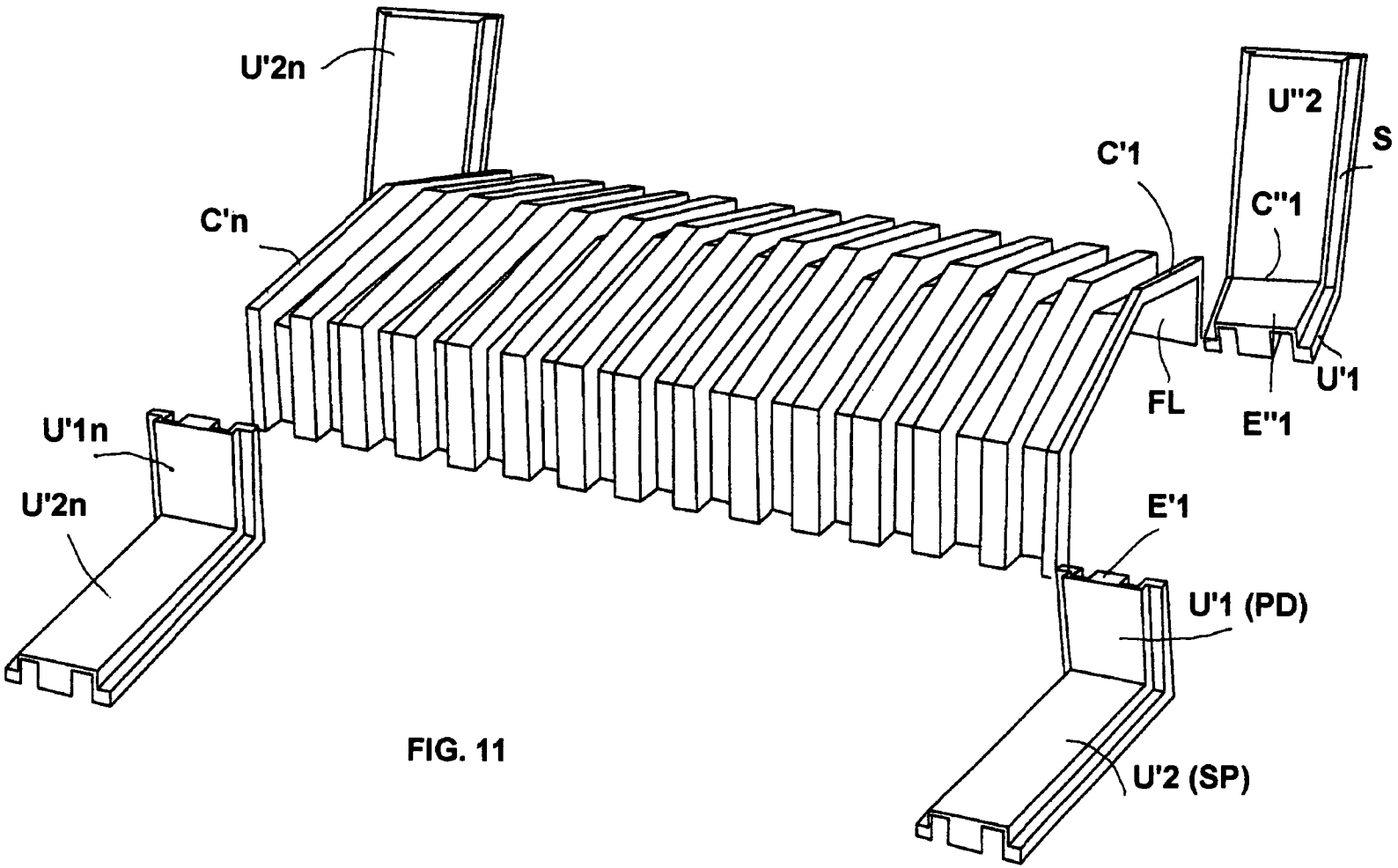
Figure 12:
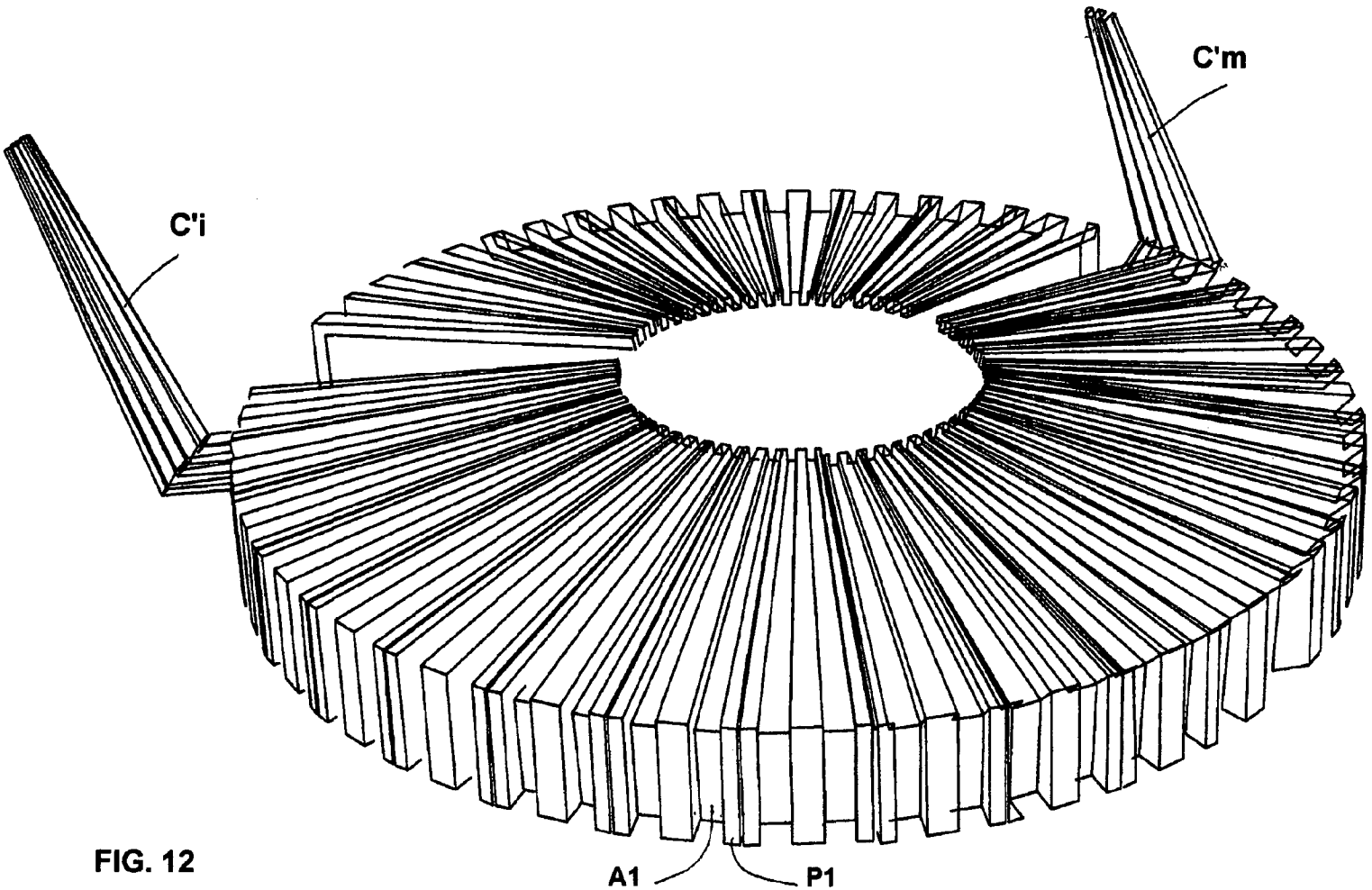

As anticipated, the system according to the invention is, above all, characterized in that is shows high versatility and flexibility as it is applicable not only to the construction of self-standing buildings (see f.i. FIG. 10) but also for the covering or closure of bodies and spaces and the like already provided of roof, and roof lines structures (FIGS. 11 and 12). Just to better fix ideas, in the figures from 1 to 1C are shown (in schematic front views) system of the first type having components C with three sub-components U1, U2, U3:

U1, vertical basic sub-component of the pier type;

U2, shoulder sub-component; and

U3, roof-line sub-component.

Later on it will be seen from FIGS. 11, 12 and 13 that U3 can be optional and thus be omitted. Coming back to the self-erecting buildings comprising components C with three sub-components U1, U2 and U3, it can be evicted from the relative figures the further characteristics of flexibility, modularity and composability of the system according to the invention. Indeed already in FIG. 1 the three sub-components U1, U2 and U3 are formed of one standard single element ES for neither too high nor too wide buildings.

Figure 1B:
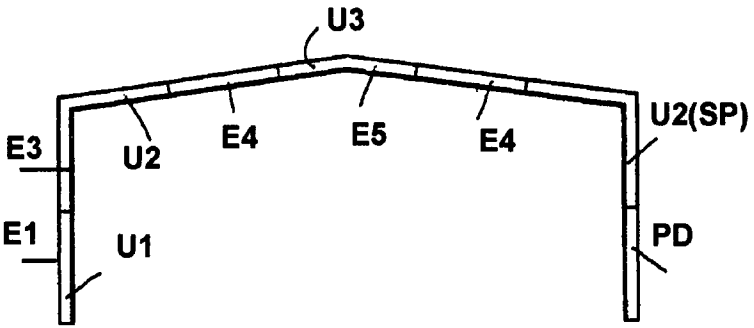
FIGS. 1, 1A, 1B, 1C, 2, 2A, 2B, 6, 6B and 9 are schematic front views.
Figure 1C:
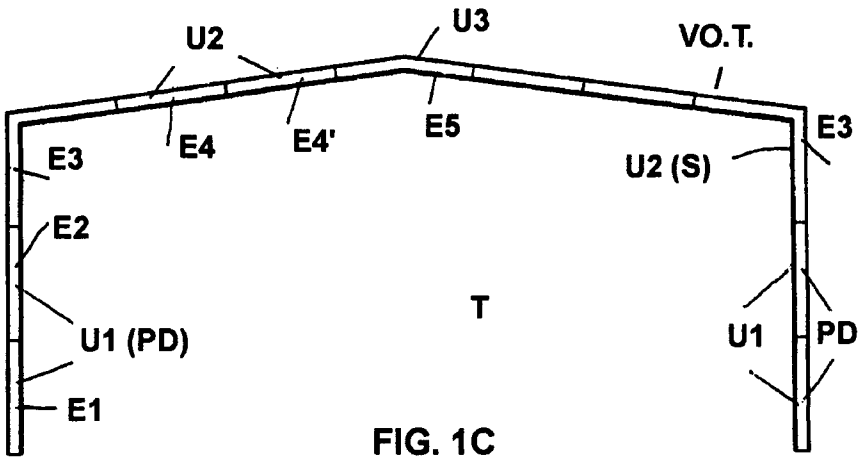
Figure 1:
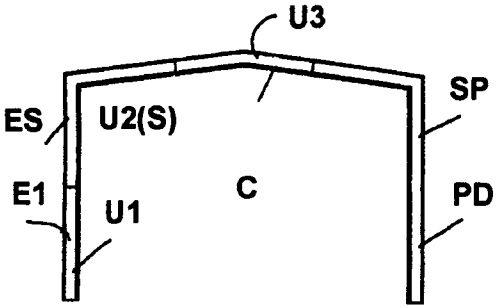
Figure 1A:
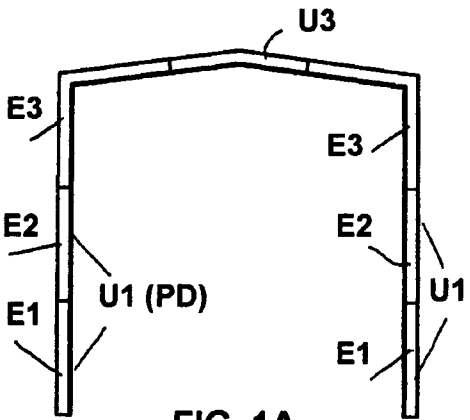

In FIG. 1A the sub-component U1 of component C1 is formed of two pier elements (at a parity of shoulder mono elements) E1 and E2 in U1, and of one element E5 in U3 (for the roof); the building is thereby widened (over those of FIGS. 1 and 1A).

Figure 2A:
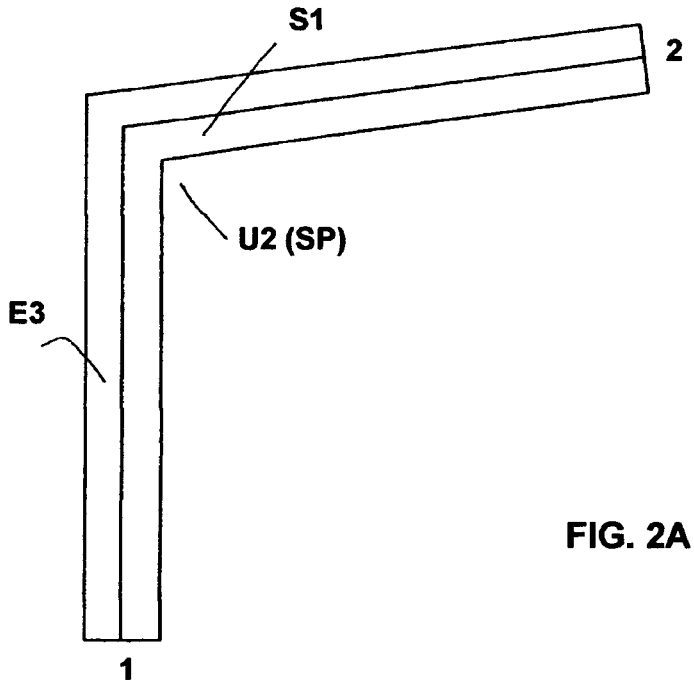
Figure 2:
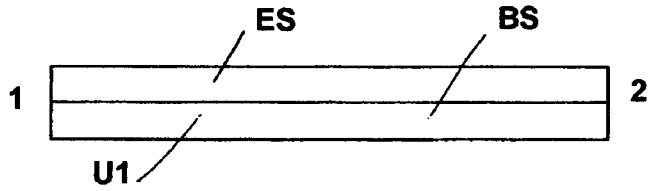
Figure 2B:
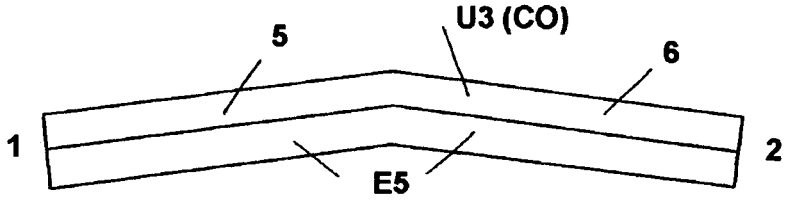
Figure 3A:
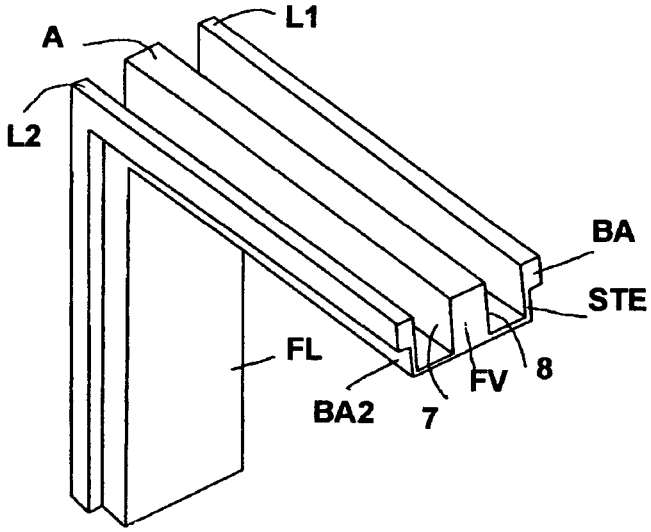
FIGS. 3, 3A, 3B, 7, 8, 10, 11 and 12 are schematic perspective views.
Figure 3:
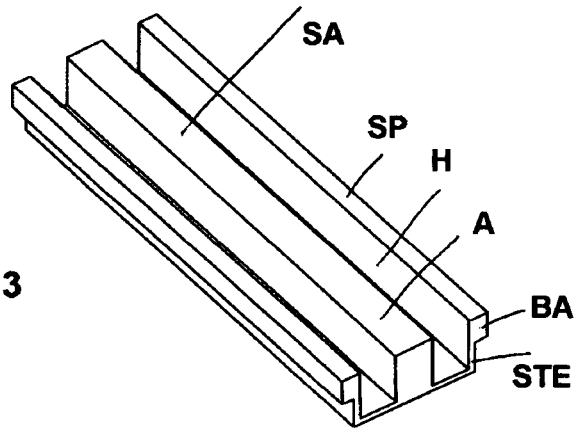
Figure 3B:
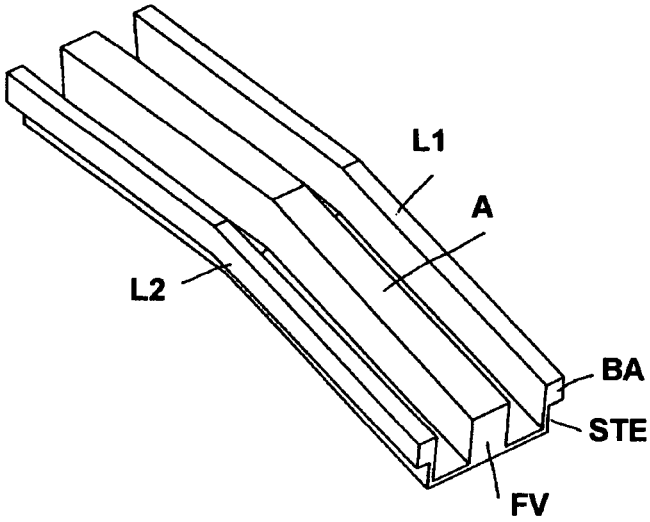

In FIG. 1C both U1 (pier) and U2 (shoulder) have additional elements (E2 respectively E4) whereby the relative systems shall be used for very wide and relatively high buildings. Characteristically all elements E1 are standard. The standard element of the base are shown in FIGS. 2, 2A and 2B and (in perspective from below) of FIGS. 3, 3A, 3B, each element being formed of a base body BS having parallelepiped or circular cross-sections. Preferably the elements ES of sub-components U2 and U3 consist of two portions 3 and 4, respectively 5 and 6 showing angles higher than 90°. As it can be better seen from FIGS. 3, 3A and 3B all three elements E of U1, U2 and U3 have, typically, the same structure, i.e. have a body (which we will call vessel or "small basin" for illustrative simplicity) VE U-shaped with a bottom FV, two lateral walls L1 and L2 and (there between, an integral central core A.

Figure 4:
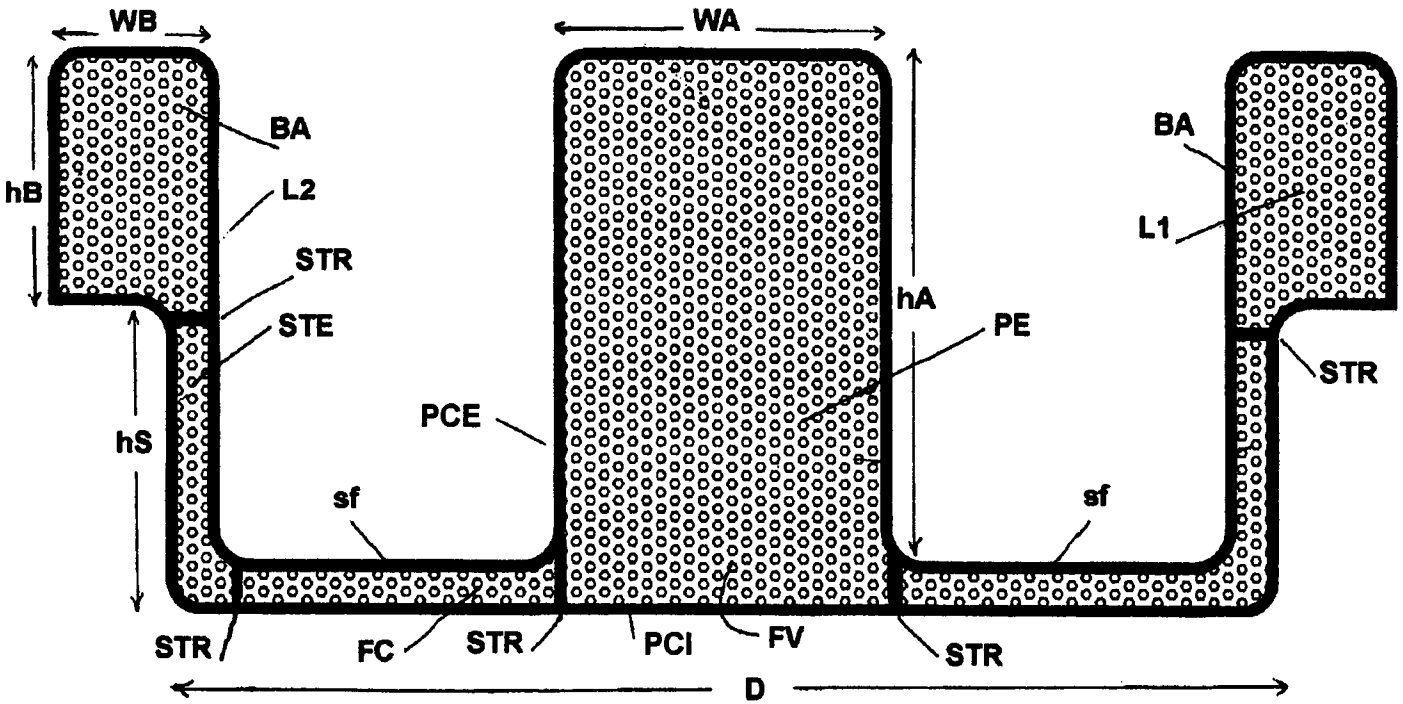
FIGS. 4, 5, 5A, 5B, 5C, 6A, 6C are cross-section views.

As it can be better seen from the enlarged cross-section of FIG. 4, said external side-walls L1 and L2 have the form of a flag having a flag-staff portion STE showing a height hs (FIG. 4) and a width equal to the thickness sp, on which there is another widened flag portion B. At each terminal 1, 2 of ES, a total structure is seen, which can be defined as formed by a core A between two channels defined by the outer faces 7 and 8 external to A and by the internal faces of walls L1, L2.

Characteristically the external face of vessel or small basin VE (U shaped body) and of the core A is covered by a layer or shell of composite material PC having a thickness "sp", whereas the inside portion of core A and of the interstices between the common bottom FV and the walls L1 and L2 is filled with foamed polymeric material PE; it has been critically found that the volumes and (at a parity of foamed polymeric filler PE and of shell PC), the weights and therefore the values of the stress resistances, shearing stress etc. of core A (having a width WA and a height hA) must correspond to the double of the volumes (weights and resistances) of the lateral bodies L1 and L2 and of the bottom FV-FC i.e. substantially (at a parity of depth)

$$WA \times hA = 2(WB\ hB + 2hs \times sp + sf \times D)$$

In other words the volume (apparently, major) of the core A i.e. WAhA must substantially correspond to the double volume of the bodies external to A, thus those of the flag portions, of the stems L1 and L2 and of the bottom FC-FV.

Figure 6C:
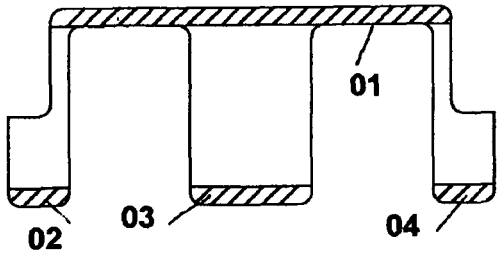
Figure 6A:
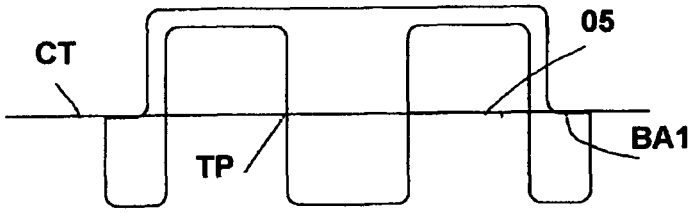
Figure 6B:
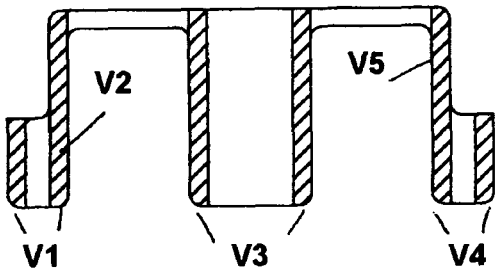
Figure 6:
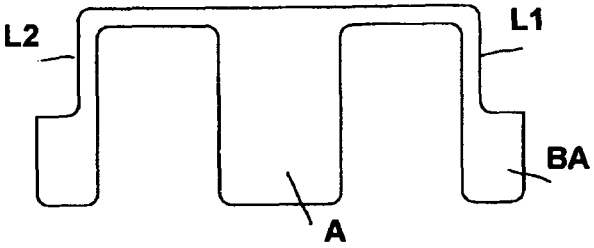

Consequently, at a parity of film layer, of filler and of volumes it is so possible to obtain a marked equivalence of mechanical characteristics between resistance zone of horizontal extremity O1, O2, O3, O4 of FIG. 6A as well as an equivalence of stiffening and resistance to shearing stress forces of the (dashed) vertical resistant zones V1, V2, V3, V4, V5 (FIG. 6B). Therefore the centroid medial position of FIG. 6A must be exactly on the passage transition TP from the stem to the flag bottom of walls L1, L2. Practically it is as if the medial line CT be seated on the bottoms 30-31 of the flag zone BA1 of L1 and BA2 of L2.

Accordingly a resistance on all the system walls is obtained which is compatible with several schemes of loads or stress, even maintaining a same typology of cross-section, f.i. of the type shown in the drawings. This allows a high productive easiness in the production center of the base sub-components. In other words same sub-components can be used to realize different systems.

Preferably the shell or film layer PC is formed of one of the composite cloths or fabrics of Toray, f.i. according to U.S. Pat. No. 6,599,610 (stitched laminates) and the filler PE is selected among the polyurethane, polyepoxy-, polystirene resins and the like, preferably foamed, with the addition of the polymeric glue, f.i. polyurethane. Manufactured articles are thereby obtained which totally consist of synthetic materials and thus are very light, equilibrated and highly resistant to the stress to which are submitted.

According to an advantageous feature, the two film layers (external PCE and internal PCI) are mutually connected through a series of strips STR of the same material PC to increase the under-load stability of the whole shell.

Figure 5:
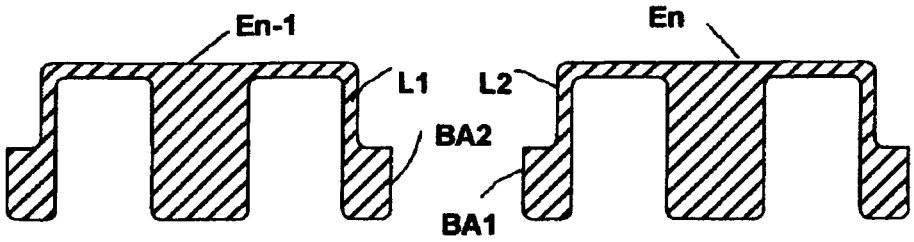
Figure 5C:
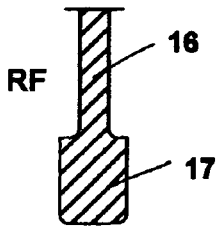
Figure 5A:
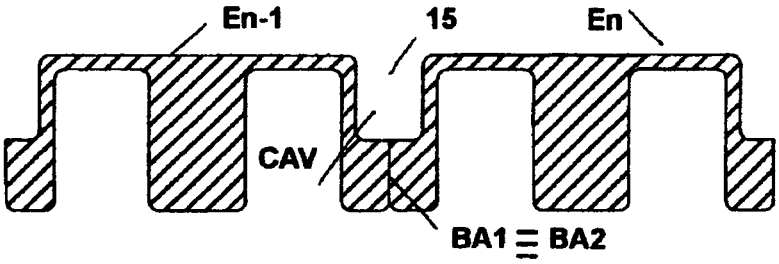
Figure 5B:
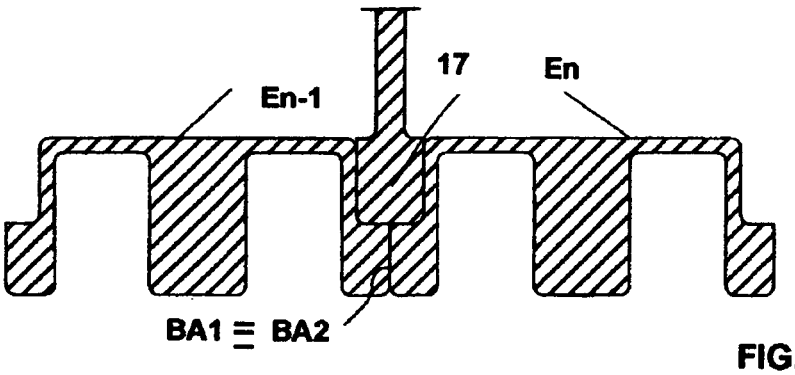
Figure 7:
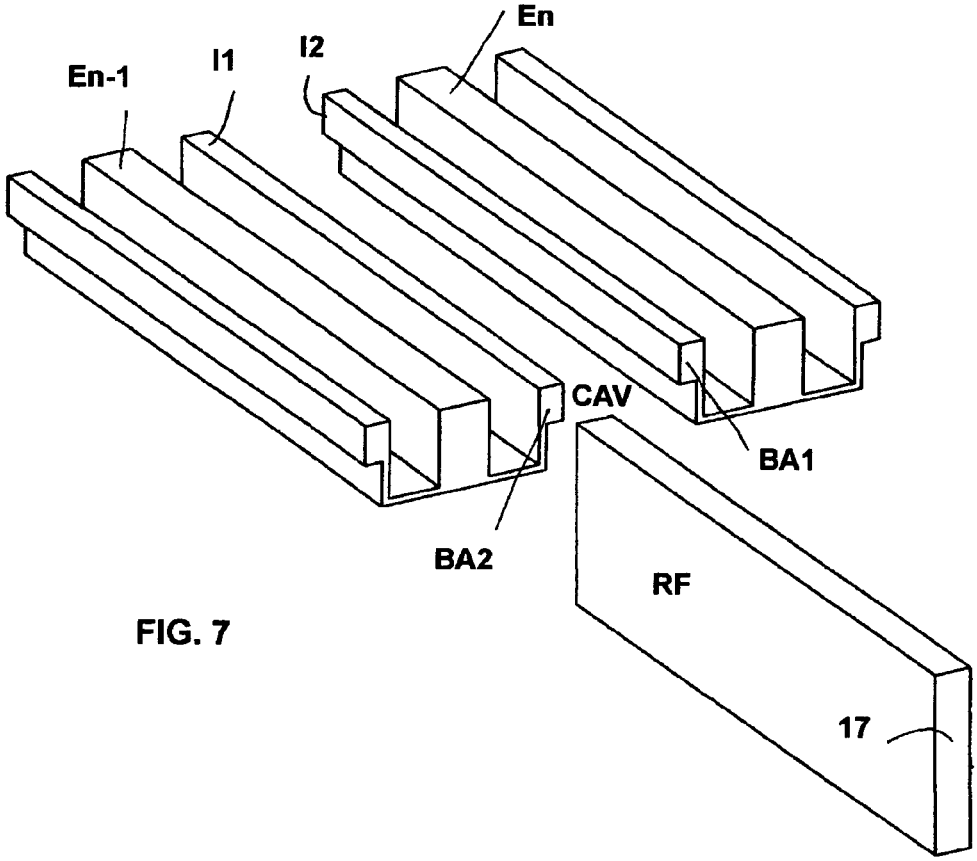
Figure 7A:
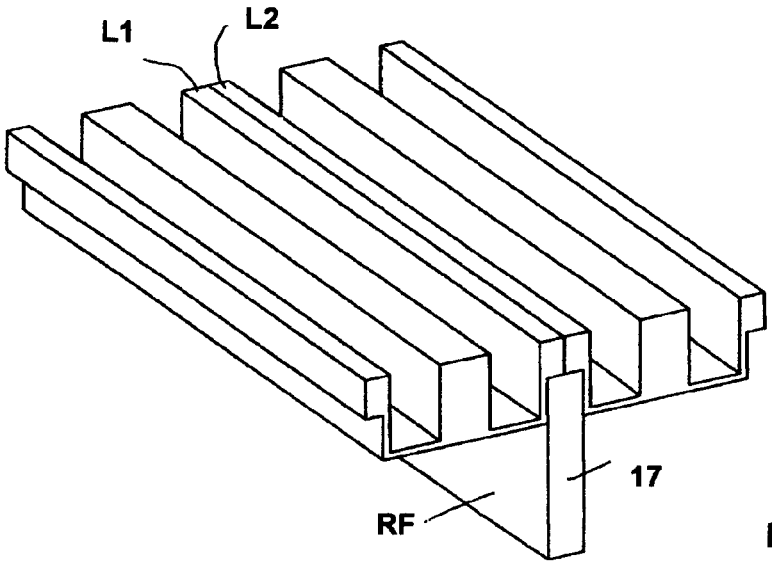

In the FIGS. 5, 5A, 5B, 5C, the coupling between two elements $E_{n-1}$ and En is shown, which are drawn near to each other by fitting together the internal faces BA1, BA2 of the flag widened heads. From the contact correct "apposition" of said two elements a quarry CAV is obtained in which is (preferably) inserted the head 17 attached to the stem 16 of a reinforcing body RF (FIG. 5C). This connection operation between two standard elements $E_{n-1}$ and En is also shown in perspective view in the FIGS. 7 and 7A. In FIG. 7 are represented the two separated elements $E_{n-1}$ and En, the internal wall L1 of $E_{n-1}$ being in front of wall L2 of En. The flag zones BA1 and BA2 of said two elements $E_{n-1}$ and En are put in contact so to form cavity CAV wherein the reinforcing body RF (f.i. the film layer or shell) is inserted. The perspective view of FIG. 8 shows the connection of two elements $E_{n-1}$ and En both represented with their full faces FP1, FP2 overturned to get f.i. the continuous locus of the exposed faces external to the manufactured article, in contrast to FIG. 10 in which the article shows externally the whole continuous face.

Figure 8:
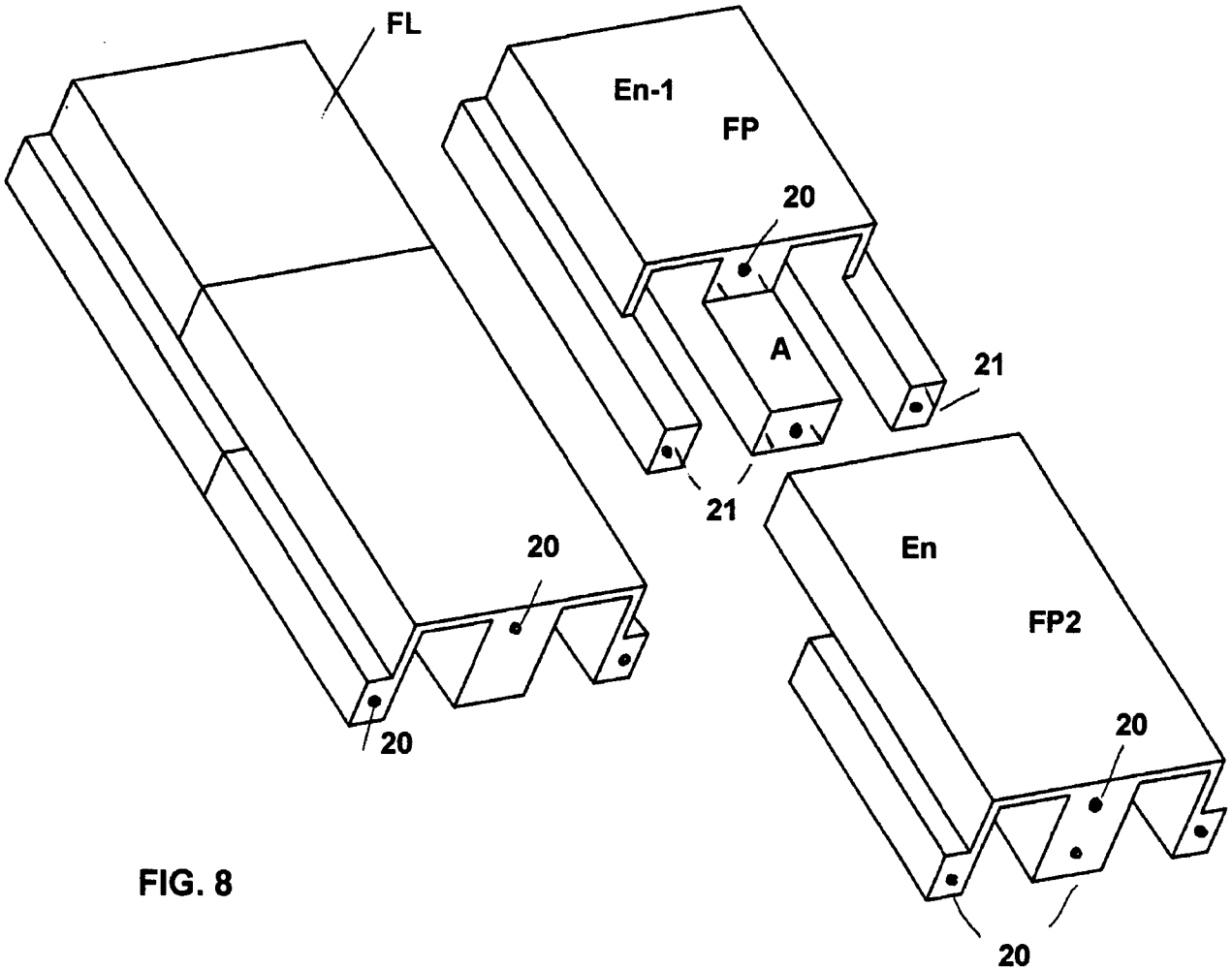

To render more comprehensive the "soldering" between elements, in FIG. 8 are represented internal portions $E_{n-1}$ of protruding from the continuous face FP1, and inserting into the similar portions of FP2 receding from the external surface FP2.

Thanks already to this insertion with form retention, a good connection resistance is obtained which however is increased by using resinous glueing pastes and/or by the insertion of at least one small cable 20 (made of polymeric material such as aramid, dyneema and the like) within the proper holes in the elements En. Even if the gluing per se and the insertion of the polymeric cable 20 can be contemporaneously utilized, the adoption of the sole cable is preferable because it allows a rapid disassembly of the structure. The correct alignment of the two elements is assured by pins 21 positioned on the contact surface; said pins assure advantageously also the continuity of the stress between the jointed pieces.

Figure 9:
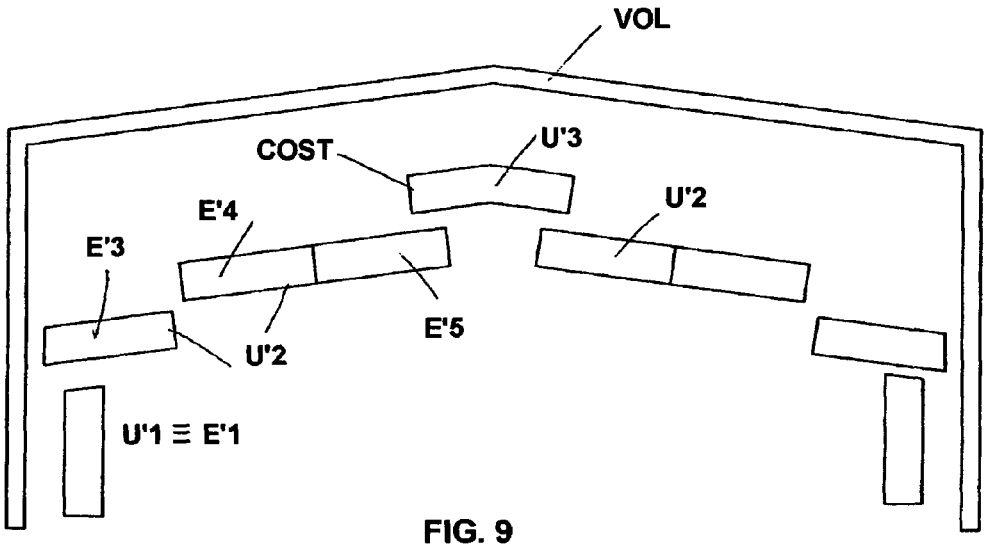
Figure 9A:
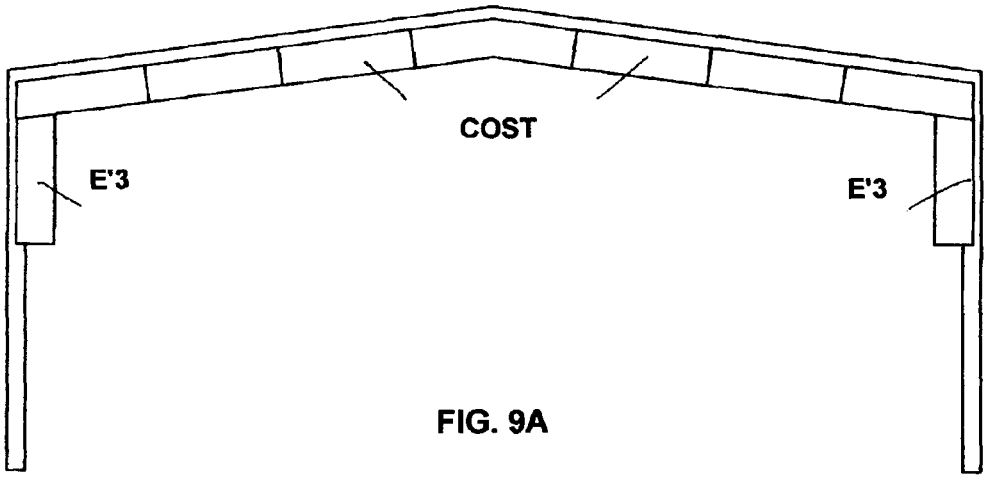

In the FIGS. 9 and 9A is shown a system of reinforcing ribs desirable in the cases of building bodies having big spans f.i. higher than 10 meters. The rib component consists of sub-components U'2 and U'3 made of substantially similar elements compatible with those of the not reinforced structure T. The elements E' shown loose and detached under the vault VOL of frame T in FIG. 9, are compacted in situ as in FIG. 9A generating the assembled rib structure Cost forced under the internal roof of the starting frame T.

Advantageously also here the element types of the possible sub-component U' 1 and of the certain U'2, U'3 are compatible with the different system "typologies" (f.i. of FIG. 1) which are thereby reduced to three.

In FIG. 10 is emblematically represented a self erecting body structure obtained with n components all having the three sub-components U1, U2 and U3 of FIGS. 1-1C, said n components being assembled by the connections of the FIGS. 4, 5-5B, 6-6B, 7-7A, 8 preferably "ribbed" as in FIG. 9 in the case of big spans.

From said FIG. 10 appears that the full (smooth) faces EP1, FP2 . . . FPn of the bottoms of elements En of FIG. 9 (equivalent to the bottoms FV of FIG. 4) are inside the manufactured article. Obviously an inverted configuration can be used in correspondence of different requirements (changes, utilization etc.).

In the FIGS. 11 and 12, manufactured articles (f.i. roofing) are shown whose components C' do not have the optional roofing sub-components, obtained now with elements E'3,E'4 of shoulders (SP) of U'2 (FIGS. 1-1C). In the top perspective of FIG. 12 (f.i. to cover sport implants, washer vessels and the like) the ridge (sub-component U'3) is quite absent.

The structures of FIG. 11 (on rectilinear trace) and of FIG. 12 (on circular or elliptic trace) show a further inventive characteristic of extreme utility in the sense that at least some components like C'1-C"1 and C'1*n*-C"n in FIG. 11, the component group are made of mobile gores, f.i. can be turned around the end of the last pier element E'1 of U'1, respectively E'n of U'n opening thereby provisional gaps for the machine movement, for the space ventilation, for their configuration etc.

Among the manufacture articles which can be quickly realized with the system according to the invention, we can mention:—stores, car garages, schools, laboratories, civil and military facilities, hospital especially field hospitals, first and second line structures etc.

Among the advantages of the manufacture articles obtained with the system according to the invention (in particular with the aid of components having three sub-components) we limit our self to mention the 18 following ones:

1. A module consisting of flat, strong, resistant walls can be placed side by side and connected with other modules.
2. Capacity of considerable loads, high specific resistance, thanks to the innovative tubular conception (FIG. 6B) of the load bearing shell structure, (instead of separate skins as in the conventional sandwich panels).
3. Possibility of pillar-less high bays up to 25 meters, even under snow and wind.
4. Air-sealed structure which can be de-pressurized for the odours or pressurized against external pollutants.
5. Rapid assembly and disassembly (about 200 $m^2$/8 hours/3 persons).
6. Dry assembly thanks to dry restrained joints or gluing.
7. Simple manual assembly with the aid of form joints needing small fixture but without lifting means.
8. Self mounting:—the particular lightness and stoutness allows to hoist the pre-assembled portals and to use them as support for the further pieces.
9. Light and easy transportation (8-12 $Kg/m^2$).
10. Modularity:—it can be manufactured with different highness and width to comply with several requirements (FIGS. 1-1C).
11. High thermic insulation with savings of energy.
12. Natural balistic protection (against projectiles) because of the particular form of the structure. Indeed a projectile has to pass through at least two film layers.
13. Electric energy generation by means of solar panels integrated in the external coating without variations of weights and forms.
14. Integrated electromagnetic shielding without weight and form variations.
15. Possible total transparency to the electro-magnetic waves (no form and weight variation).
16. The tubular cross-section of the base module provides a natural space for the lighting, the ventilation and tubular implants.
17. High chemical resistance (naturally inert and not-oxidizable).
18. Easy repairing by substitution of the single damaged elements.

In the specific case of cleaners, (depurators) coverings, the structures of the invention made of composite materials (polyurethanes, carbon- and glass-fibers etc.), obtained with components having two sub-components and showing high resistance and lightness which allow the embodiment of covers and boundary lines of a single span up to (f.i.) 20 meters, show the following advantages and inconveniences.

Advantages:

No interference with the underlying plants like the moving bridges, weir zones etc. Indeed the structure of the invention runs above them and is totally free.

The construction systems imparts stability, resistance and insulating power of the material, which cannot be obtained with the conventional glass resin roof tiles.

Big structures of high dimensions can be obtained with containment of pressed gas, thus in total security (explosion resistant structures).

Easy access under the cover for the inspection and maintenance of the machineries.

High insulation power of the cover (sandwich structure) which consents the temperature stabilization to the optimal values for f.i., the best biological (during the transition seasons and winter). The reflecting finish in combination with the high insulation power keeps to a minimum the heating effect of the summer solar irradiation.

Energetic Recovery:—possibility to integrate heaters/recovers of heat/photovoltaic cells in the structure skin (without external overall dimensions [encumber]). Drawbacks:

Possible higher external encumber to avoid interface with the below implants and consent a free passage under the cover.

For clear illustration scruple, the invention has been described with particular reference to the embodiments shown in the accompanying drawings which are nevertheless, susceptible of those variations, substitutions, additions and the like which, being in the hand reach of a mean technician of this field, are to be considered as falling within the scope of the following claims.

The invention claimed is:

1. A system to bring about buildings comprising modular components, wherein said components which are substantially in form of polylateral frames, consist of at least two sub-components, one called pier and the other called shoulder, each formed by standard elongated elements having a specific cross-section for reciprocal coupling, wherein said specific cross-section consisting essentially of a U-shaped body having one common bottom wall, first and second side walls over said bottom wall at opposite ends thereof wherein tops of each of the first and second side walls have enlarged portions, as well as one core over said bottom wall at the center thereof, said walls and said core being coated by a skin layer made of carbon-fibre and/or glass-fibre compositions, and being filled by co-polymeric material;

wherein the first side wall has a flag shape and a flagstaff portion superiorly surmounted by a wide zone portion expanding towards the outside and the second side wall has a flag shape and a flagstaff portion superiorly surmounted by a wide zone portion expanding towards the outside.

2. The system of claim 1, further comprising second sub-components and an optional third sub-component wherein the ends of said second sub-components are hooked with ends of an optional third sub-component acting as roof ridge.

3. The system of claim 1, wherein the area, volume, weight and mechanical resistance of said core which is coated by carbon-fibers shell-layers and is filled with expanded polymeric material, correspond to double of the area, volume, weight, tension resistances of the bodies around said core and of their relevant bottom.

4. The system of claim 1, wherein the coupling structure consisting of a U-cup with flag portions on the lateral walls thereof develops such high mechanical resistance to render it compatible with practically all the conditions of charges in all its points, whereby a same structure is used for different couplings.

5. The system of claim 4, wherein with said same coupling form provides an easy interchangeability of said various sub-components and a high simplification of the plant production is assured.

6. The system of claim 1, wherein inner and outer walls of a composite shell are interconnected by reinforcing composite transversal stripes to enhance the mechanical resistance of whole composite device as a consequence of its major stability.

7. The system of claim 1, wherein the side ends couplings is carried out by inserting one element end in the corresponding portion of a second element so to have a strong form constraint reinforced by adhesives and or by a polymer material cable passing through the cores of the two elements to be coupled, whose alignment is made by spins outside projecting from the cores.

8. The system of claim 1, wherein an additional reinforcing rib network is applied to the inner face of a frame vault.

9. The system of claim 1, in which the covering of a roof-ridge-less building is carried out by sub-component with over turnable gore like elements.

10. The system of claim 1, wherein said wide zone portion of said two side walls have a total width corresponding to the width of said core.

11. The system of claim 10, wherein the side distance between each of said two side walls and said core corresponds to said total width.

* * * * *